US010551786B2

(12) United States Patent
Iwai et al.

(10) Patent No.: US 10,551,786 B2
(45) Date of Patent: Feb. 4, 2020

(54) IMAGE FORMING APPARATUS INCLUDING OPTICAL PRINT HEAD

(71) Applicant: CANON KABUSHIKI KAISHA, Tokyo (JP)

(72) Inventors: Hitoshi Iwai, Abiko (JP); Daisuke Aruga, Abiko (JP); Shinichiro Hosoi, Tokyo (JP); Toshiki Momoka, Tokyo (JP); Takehiro Ishidate, Tokyo (JP); Yuya Tamura, Tsukuba (JP); Shinichiro Kaikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/211,713

(22) Filed: Dec. 6, 2018

(65) Prior Publication Data

US 2019/0179252 A1 Jun. 13, 2019

(30) Foreign Application Priority Data

Dec. 7, 2017 (JP) ..... 2017-235475

(51) Int. Cl.
*G03G 21/00* (2006.01)
*G03G 15/04* (2006.01)

(52) U.S. Cl.
CPC ..... *G03G 21/007* (2013.01); *G03G 15/04036* (2013.01)

(58) Field of Classification Search
CPC ..... G03G 21/007; G03G 15/04036; G03G 15/011; G03G 21/00; G03G 15/04054
See application file for complete search history.

(56) References Cited

U.S. PATENT DOCUMENTS

| | | | |
|---|---|---|---|
| 7,898,559 | B2 | 3/2011 | Kobayashi |
| 8,269,812 | B2 | 9/2012 | Morimoto et al. |
| 9,205,670 | B1 | 12/2015 | Ganesan et al. |

(Continued)

FOREIGN PATENT DOCUMENTS

| | | | |
|---|---|---|---|
| JP | 02-150882 | A | 6/1990 |
| JP | 2005-035158 | A | 2/2005 |
| JP | 2007-072321 | A | 3/2007 |

(Continued)

OTHER PUBLICATIONS

U.S. Appl. No. 16/166,511, Shinichiro Hosoi Hitoshi Iwai Yuya Tamura Takehiro Ishidate Toshiki Momoka Daisuke Aruga, filed Oct. 22, 2018.

(Continued)

*Primary Examiner* — Sandra Brase
(74) *Attorney, Agent, or Firm* — Venable LLP

(57) ABSTRACT

An image forming apparatus includes a main assembly, a photosensitive drum, an optical print head, a receiving portion, a portion-to-be-engaged, and a guiding portion. The guiding portion is provided between the portion-to-be-engaged and the receiving portion with an interval from both the portion-to-be-engaged and the receiving portion. The guiding portion guides movement of a cleaning member in a direction from the receiving portion toward the portion-to-be-engaged while limiting movement of the cleaning member in a direction different from the longitudinal direction of the cleaning member to engage the engaging portion with the portion-to-be-engaged.

18 Claims, 11 Drawing Sheets

(56) References Cited

U.S. PATENT DOCUMENTS

| | | | | |
|---|---|---|---|---|
| 2009/0162117 | A1* | 6/2009 | Yamada | G03G 15/326 399/343 |
| 2015/0104212 | A1* | 4/2015 | Nishikawa | G03G 21/0035 399/98 |

FOREIGN PATENT DOCUMENTS

| | | | |
|---|---|---|---|
| JP | 2007-206579 | A | 8/2007 |
| JP | 2009-122427 | A | 6/2009 |
| JP | 2010-230954 | A | 10/2010 |
| KR | 10-2005-0108058 | A | 11/2005 |

OTHER PUBLICATIONS

U.S. Appl. No. 16/166,530, Toshiki Momoka Daisuke Aruga Hitoshi Iwai Shinichiro Hosoi Takehiro Ishidate Yuya Tamura, filed Oct. 22, 2018.

Office Action dated Oct. 23, 2019, in Japanese Patent Application No. 2017-235475.

* cited by examiner (a)

(b)

(C)

(a)

(b)

(a)

(b)

(a)

(b)

(c)

(a)

(b)

COMPARISON EXAMPLE

IMAGE FORMING APPARATUS INCLUDING OPTICAL PRINT HEAD

FIELD OF THE INVENTION AND RELATED ART

The present invention relates to an image forming apparatus capable of easily cleaning a light emergent surface of a lens array of an optical print head.

In image forming apparatuses such as a printer and a copying machine, there is an image forming apparatus provided with a plurality of light emitting elements for exposing a photosensitive drum to light. The optical print head includes an LED (light emitting diode), an organic EL (electro-luminescence) device or the like as an example of a light emitting element (device), and an optical print head in which the light emitting elements are arranged along a rotational axis direction of the photosensitive drum in a row (line) or in two (plurality of) rows (lines) with a staggered pattern has been known. Further, the optical print head includes a plurality of lenses for focusing light beams, emitted from the plurality of light emitting elements, onto the photosensitive drum. The plurality of lenses are disposed opposed to the surface of the photosensitive drum so as to extend along an arrangement direction of the light emitting elements between the light emitting elements and the photosensitive drum.

In the image forming apparatus, an exposure means such as the optical print head is provided between a charging device and a developing device in some instances. In order to realize downsizing of the image forming apparatus, minimization of distances among the photosensitive drum, the optical print head, the charging device, the developing device and the like is an effective means. For this reason, there was a problem that the light emergent surface of the lens array is contaminated with toner falling from the photosensitive drum and the developing device. There is a liability that light beams emitted from the light emitting elements are partly blocked due to contamination of the lens array and thus a lowering in image quality of an output image occurs. Therefore, in order to prevent the contamination of the light emergent surface of the lens array, cleaning means as described in Japanese Laid-Open Patent Application (JP-A) 2010-230954 and JP-A 2007-72321 have been proposed.

An image forming unit disclosed in JP-A 2010-230954 includes a housing as an example of a casing for holding a photosensitive drum and an LPH (optical print head). In the housing, an insertion opening (receiving portion) which is an opening penetrating from an outside toward an inside of the housing is formed. An operator such as a user or a service person inserts a cleaning member through the insertion opening between the LPH 14 and the photosensitive drum, and then cleans a light emergent surface of a rod lens array.

Further, an LED print head (optical print head) disclosed in JP-A 2007-72321 includes a cleaning mechanism (cleaning member) in a head body. The head body is provided with guiding grooves (portions-to-be-engaged) for guiding movement of the cleaning mechanism on both left and right sides of the head body. At a leading end of the cleaning mechanism, an engaging portion engageable with the guiding grooves and a cleaning pad (sliding portion) for cleaning a light emergent surface of a rod lens array are provided. When the operator performs insertion and extraction of the cleaning mechanism relative to an apparatus main assembly, the engaging portion is moved along the guiding grooves, so that the cleaning pad wipes the light emergent surface and thus removes the contaminant.

However, in constitutions disclosed in JP-A 2010-230954 and JP-A 2007-72321, the following problem arose. As in the constitution disclosed in JP-A 2010-230954, the receiving portion and the lens array are disposed and spaced from each other. Between the receiving portion and the lens array, there is no portion for guiding movement of the cleaning member inserted through the receiving portion. The cleaning member is inserted through the receiving portion with some play, and in addition, the movement of the cleaning member is carried out by a manual operation of the operator, and therefore, a movement path of the cleaning member is capable of taking various routes depending on an operation of hand(s) of the operator. Here, with reference to the constitution disclosed in JP-A 2007-72321, a constitution in which the cleaning member inserted through the receiving portion is engaged with a portion-to-be-engaged formed on the optical print head will be considered. In such a constitution, in the case where the portion for guiding the movement of the cleaning member does not exist between the receiving portion and the portion-to-be-engaged, there is a liability that the cleaning member is not engaged with the portion-to-be-engaged depending on the movement path of the cleaning member.

SUMMARY OF THE INVENTION

According to an aspect of the present invention, there is provided an image forming apparatus comprising: a main assembly; a photosensitive drum rotatable relative to the main assembly; an optical print head having a light emergent surface from which light with which the photosensitive drum is exposed is emitted; a receiving portion which is provided on a front side of the main assembly in front of the light emergent surface and through which the sliding portion of the cleaning member configured to slide on and clean the light emergent surface is received from an outside of the main assembly in a longitudinal direction of the optical print head; a portion to be engaged provided on the optical print head and configured to guide movement of the cleaning member in the longitudinal direction in engagement with the engaging portion such that the sliding portion slides on the light emergent surface; and a guiding portion provided between the portion to be engaged and the receiving portion with an interval from both the portion to be engaged and the receiving portion and configured to guide movement of the cleaning member in a direction from the receiving portion toward the portion to be engaged while limiting movement of the cleaning member in a direction different from the longitudinal direction of the cleaning member to engage the engaging portion with the portion to be engaged.

Further features of the present invention will become apparent from the following description of exemplary embodiments with reference to the attached drawings.

BRIEF DESCRIPTION OF THE DRAWINGS

Parts (a) and (b) of FIG. 1 are schematic sectional views each showing an image forming apparatus.

Parts (a) and (b) of FIG. 2 are schematic perspective views showing a drum unit and a periphery thereof in the image forming apparatus.

Figure 4:
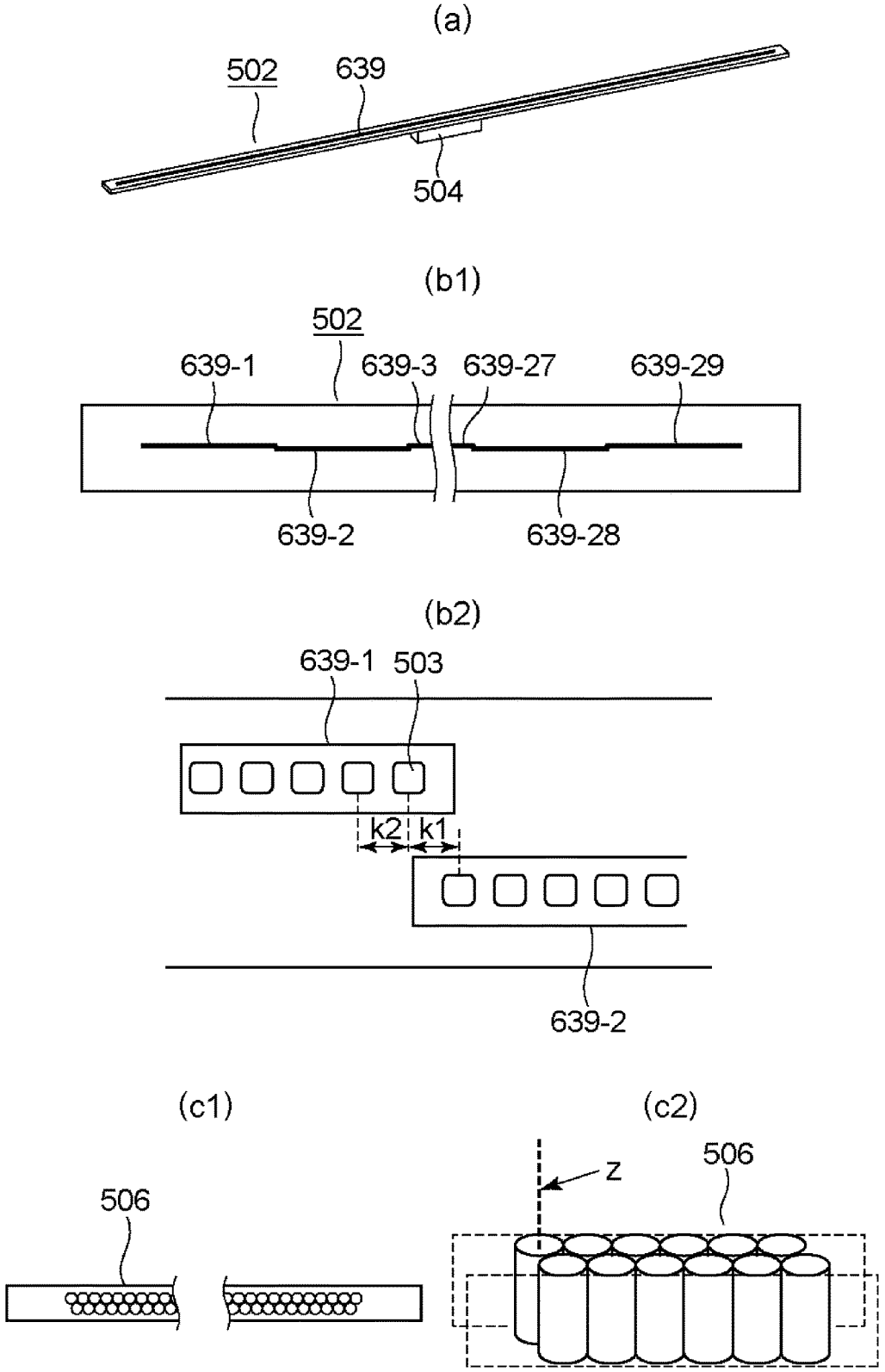

Parts (a), (b1), (b2), (c1) and (c2) of FIG. 4 are schematic views for illustrating a substrate, an LED chip or a lens array of an optical print head.

Figure 5:
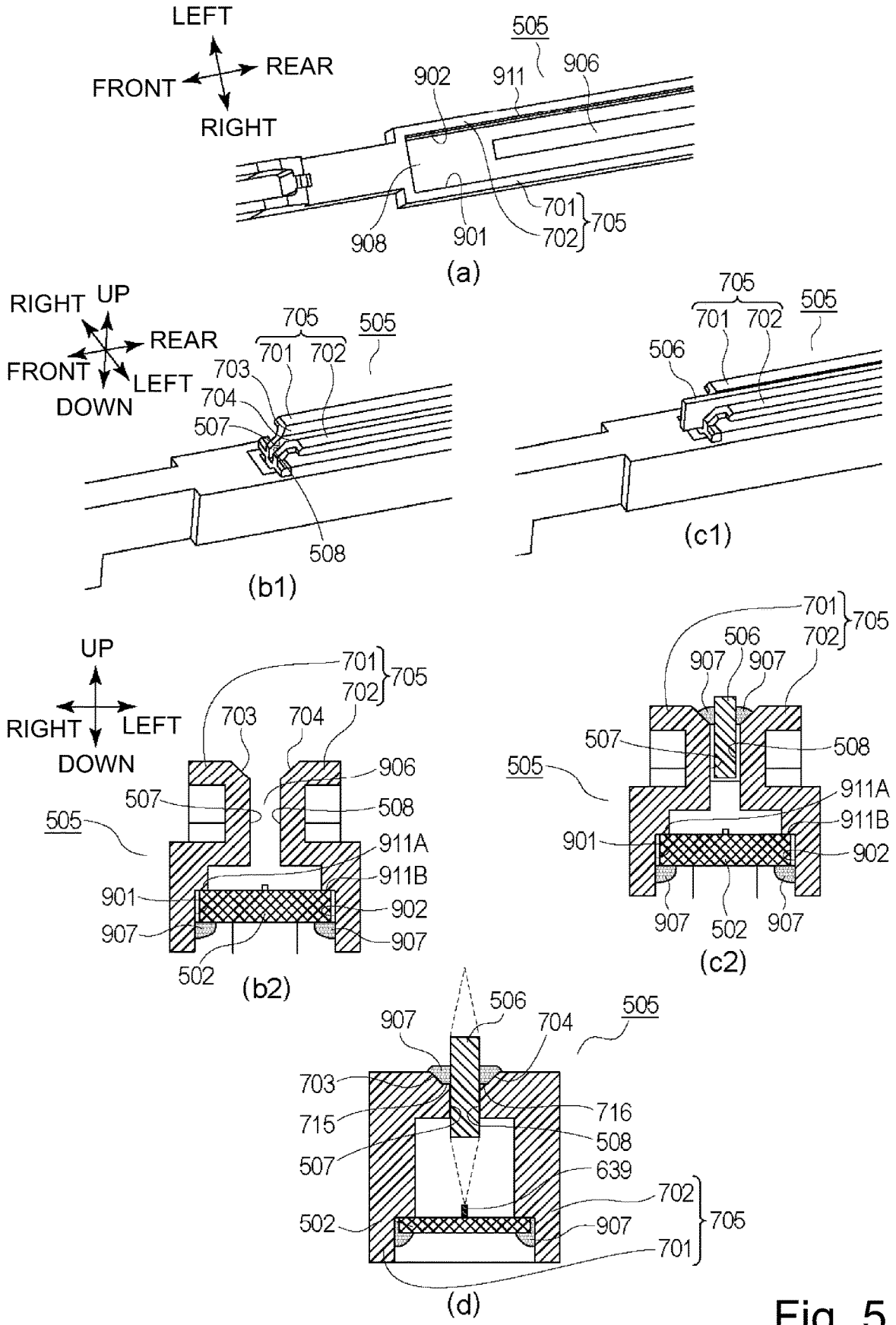

Parts (a), (b1), (b2), (c1), (c2) and (d) of FIG. 5 are schematic views for illustrating a holding member, in which the lens array and the substrate are not shown.

Figure 6:
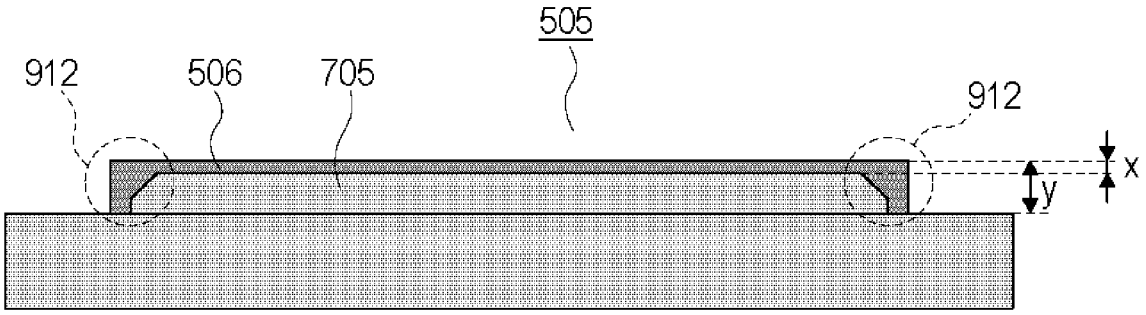
Figure 6:
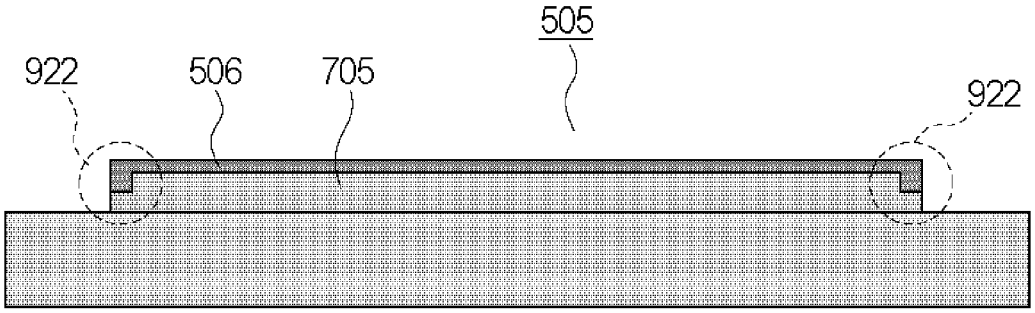
Figure 6:
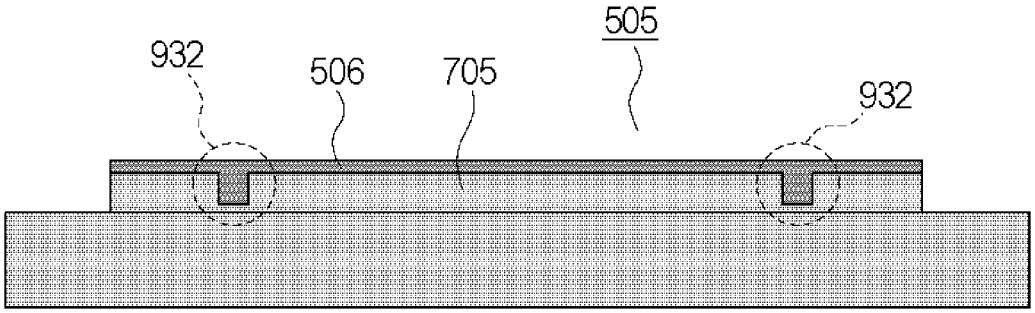

Parts (a), (b) and (c) of FIG. 6 are schematic views for illustrating a feature of a shape of a supporting portion.

Figure 7:
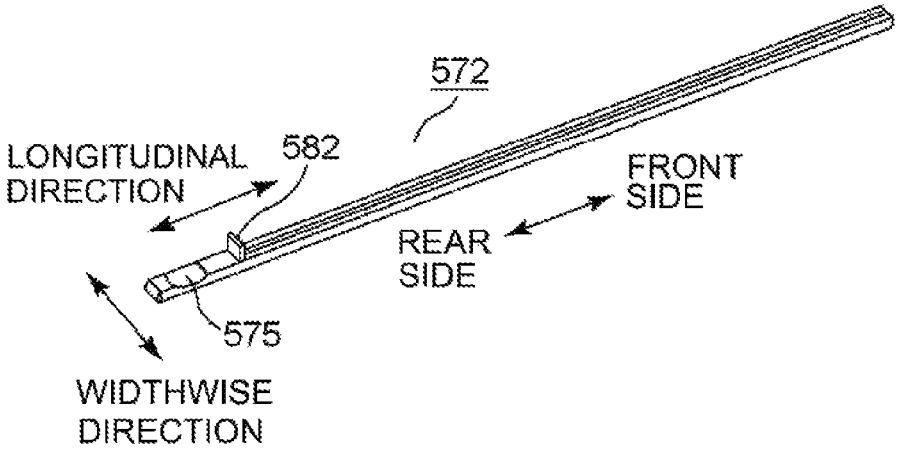
Figure 7:
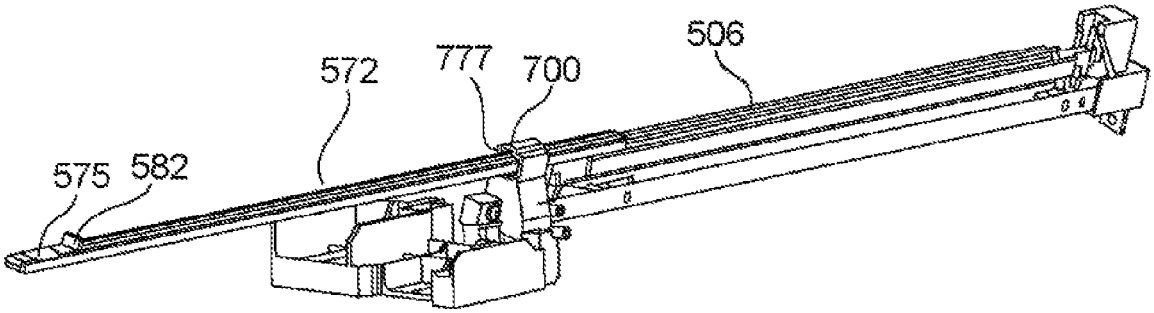

Parts (a) and (b) of FIG. 7 are perspective views for illustrating a cleaning member and a state of the cleaning member inserted through a receiving portion, respectively.

Figure 8:
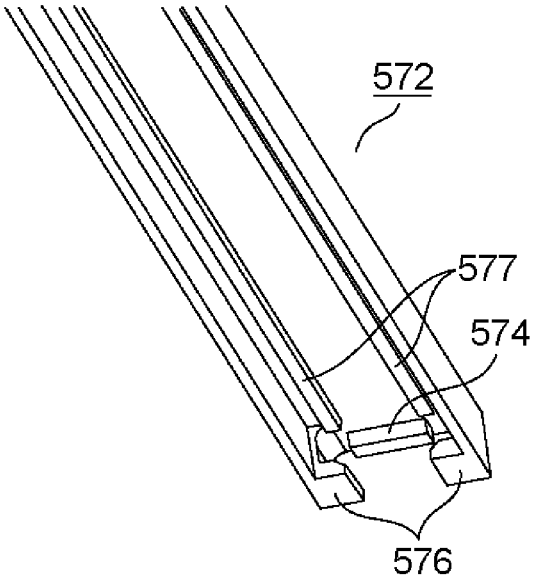
Figure 8:
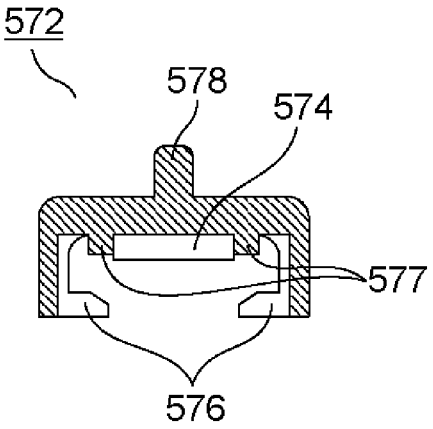

Parts (a) and (b) of FIG. 8 are schematic views for illustrating a structure of the cleaning member on a leading end side.

Figure 9:
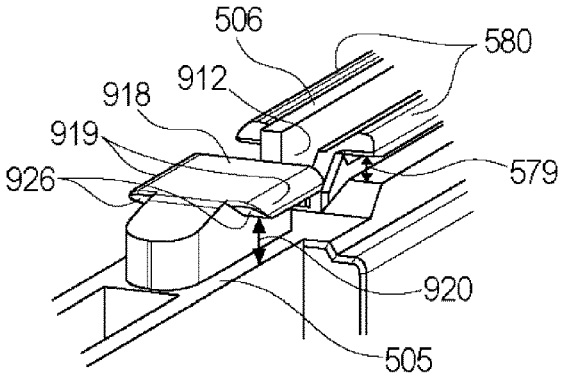
Figure 9:
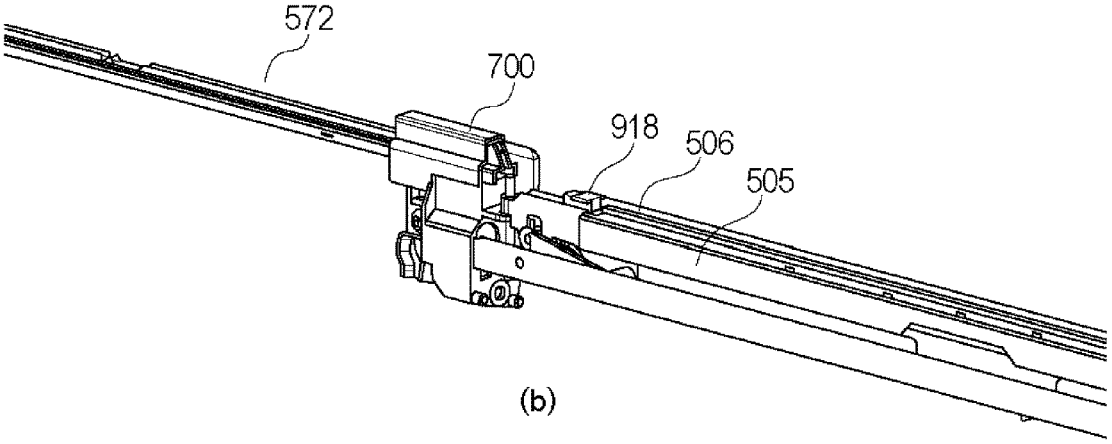
Figure 9:
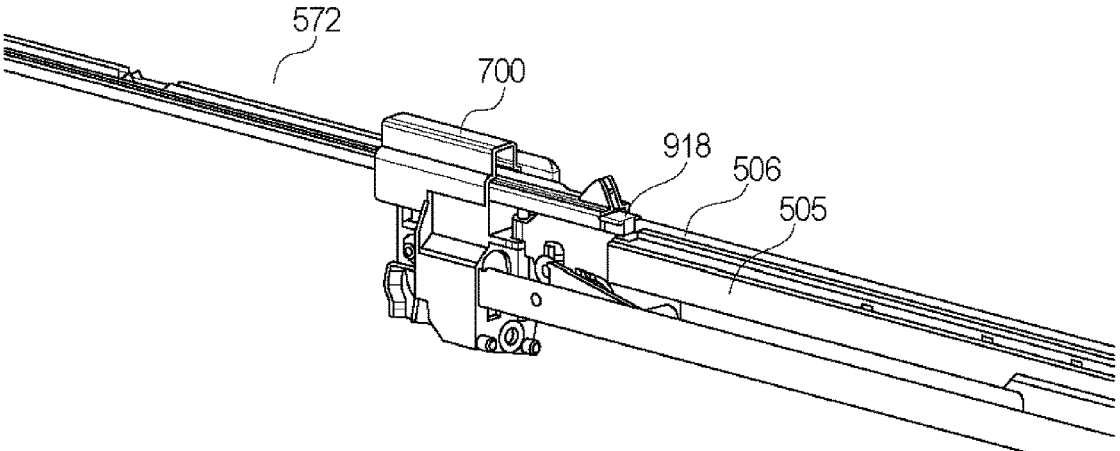

Parts (a), (b) and (c) of FIG. 9 are perspective views for illustrating a guiding portion.

Figure 10:
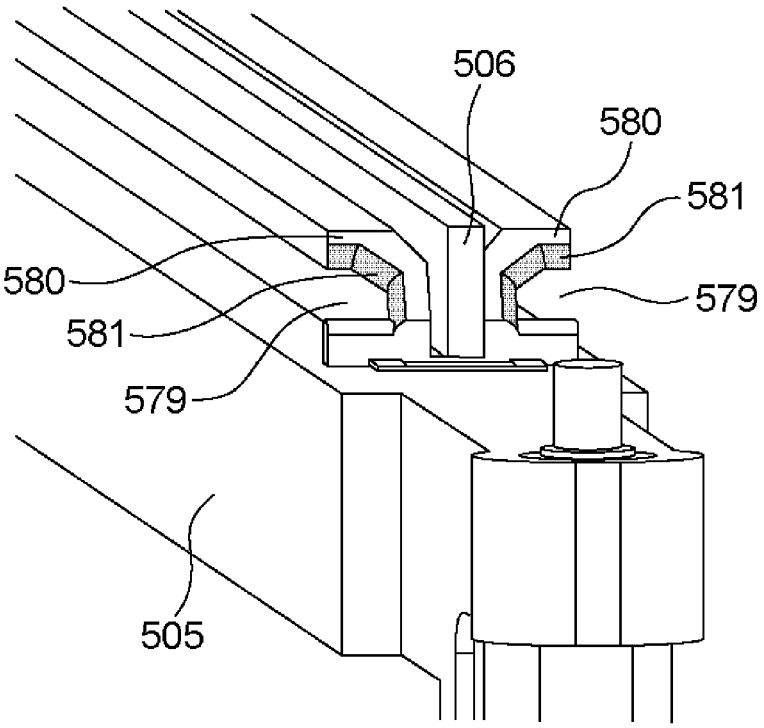

FIG. 10 is a schematic view for illustrating a structure of the supporting portion.

Figure 11:
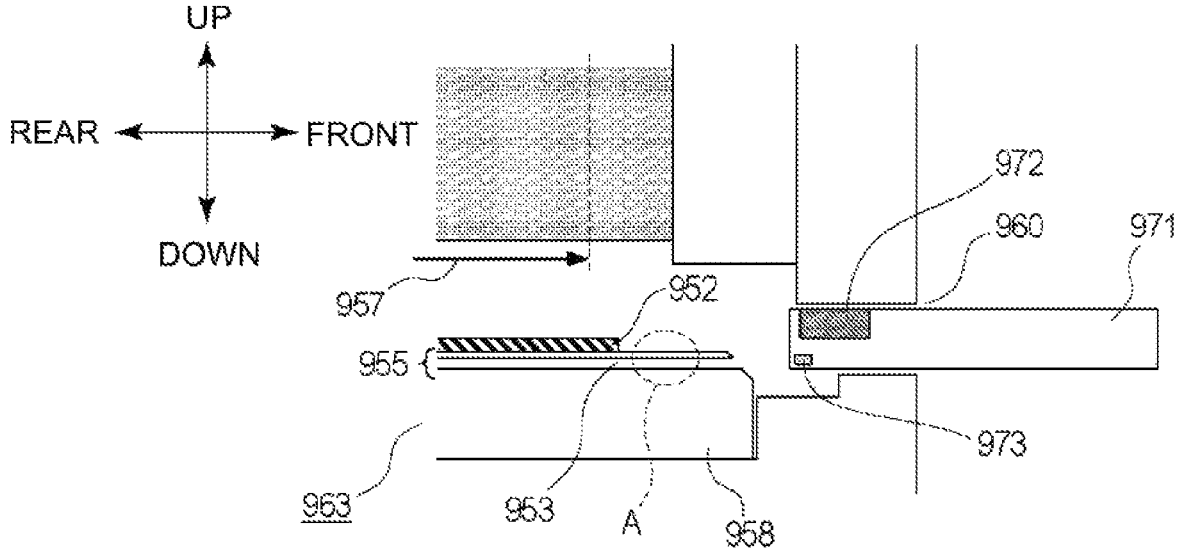
Figure 11:
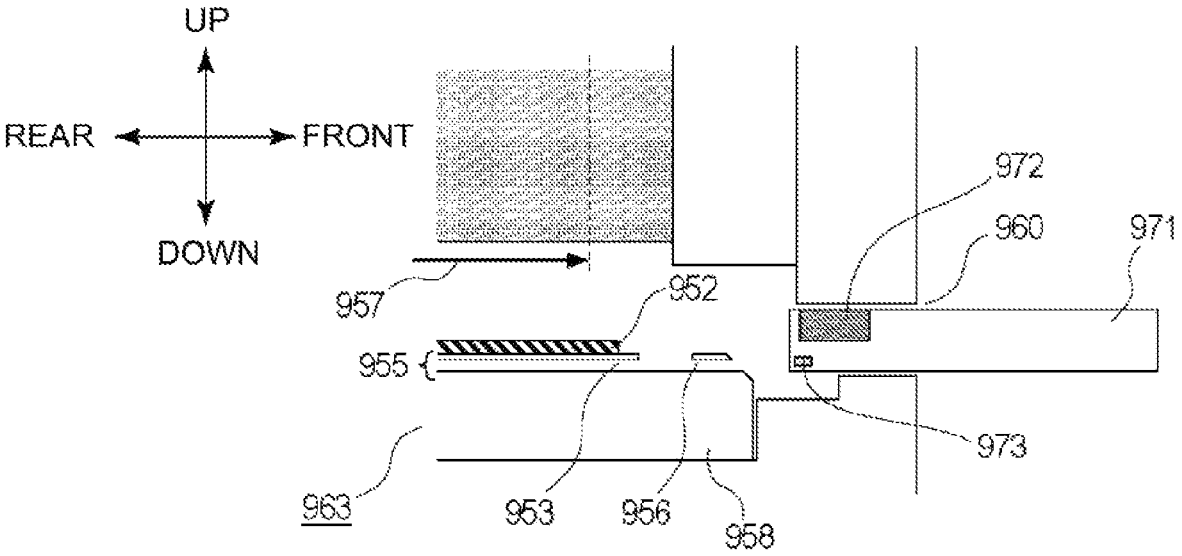

Parts (a) and (b) of FIG. 11 are schematic views for illustrating a comparison example.

DESCRIPTION OF EMBODIMENTS

In the following, embodiments for carrying out the present invention will be described using the attached drawings. However, constituent elements described in the following embodiments are merely examples, and the present invention is not limited to those in the following embodiments.

(Image Forming Apparatus)

Figure 1:
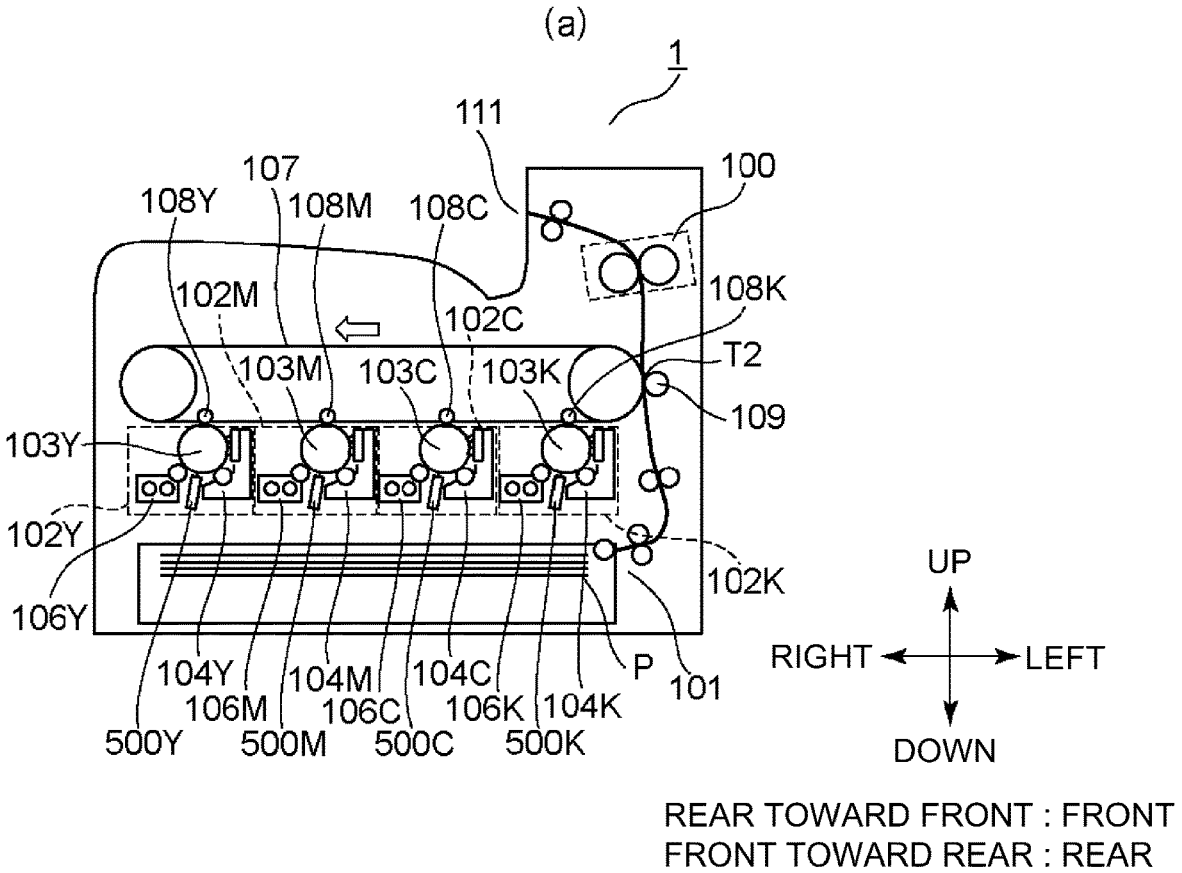
Figure 1:
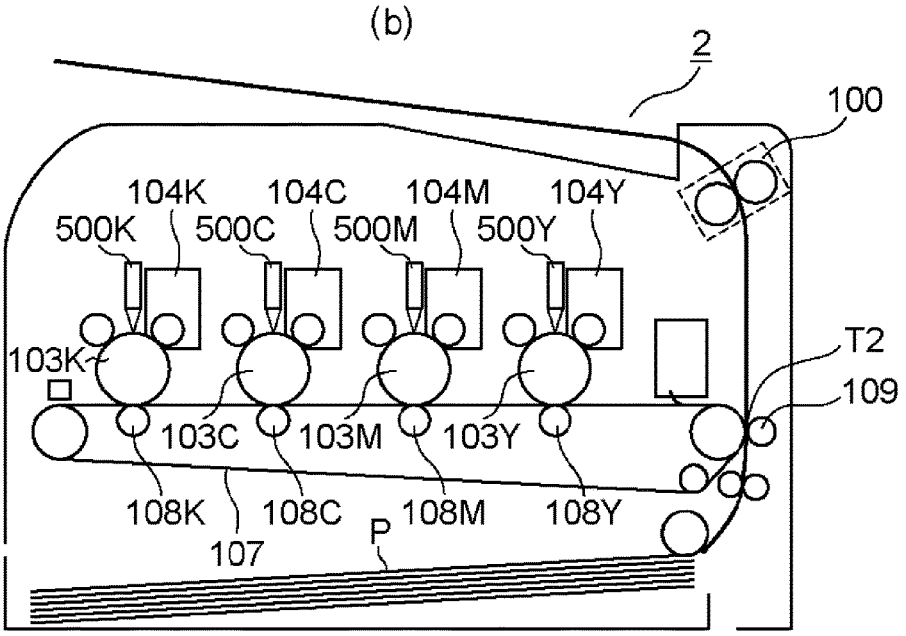

First, a schematic structure of an image forming apparatus 1 will be described. Part (a) of FIG. 1 is a schematic sectional view of the image forming apparatus 1. The image forming apparatus 1 shown in part (a) of FIG. 1 is a color printer (SFP: single function printer) including no reading device but may also be a copying machine including a reading device. Further, the image forming apparatus in this embodiment is not limited to a color image forming apparatus including a plurality of photosensitive drums 103 as shown in part (a) of FIG. 1 but may also be a color image forming apparatus including a single photosensitive drum 103 or an image forming apparatus for forming a monochromatic image.

The image forming apparatus 1 shown in part (a) of FIG. 1 includes four image forming portions 102Y, 102M, 102C and 102K (hereinafter also collectively referred to as simply an "image forming portion 102") for forming toner images of yellow, magenta, cyan and black, respectively. The image forming portions 102Y, 102M, 102C and 102K include photosensitive drums 103Y, 103M, 103C and 103K ("photosensitive drum 103"), and charging devices 104Y, 104M, 104C and 104K ("charging device 104") for electrically charging the photosensitive drums 103Y, 103M, 103C and 103K, respectively. The image forming portions further include LED (light emitting diode) exposure units 500Y, 500M, 500C and 500K ("exposure unit 500") as light sources for emitting light (beams) to which the photosensitive drums 103Y, 103M, 103C and 103K are exposed, respectively, and developing devices 106Y, 106M, 106C and 106K ("developing device 106") each for developing an electrostatic latent image on the photosensitive drum 103 with toner into a toner image of an associated color on the photosensitive drum 103. Incidentally, suffixes Y, M, C and K of the respective constituent elements represent colors of the toners.

The image forming apparatus 1 shown in part (a) of FIG. 1 is an image forming apparatus employing a so-called "lower surface exposure type" in which the photosensitive drum 103 is exposed to light from below. In the following, description will be made on the precondition that the image forming apparatus employing the lower surface exposure type is used, but in this embodiment, an image forming apparatus employing an "upper surface exposure type" in which the photosensitive drum 103 is exposed to light from above, such as an image forming apparatus 2 shown in part (b) of FIG. 1, may also be used.

The image forming apparatus 1 include an intermediary transfer belt 107 onto which the toner images formed on the photosensitive drums 3 are to be transferred and primary transfer rollers 108 (Y, M, C, K) for successively transferring the toner images from the photosensitive drums 103 onto the intermediary transfer belt 107. The image forming apparatus 1 further includes a secondary transfer roller 109 for transferring the toner images from the intermediary transfer belt 107 onto recording paper P fed from a paper feeding portion 101 and includes a fixing device 100 for fixing the secondary-transferred toner images on the recording paper P.

(Image Forming Process)

The exposure unit 500 exposes to light the surface of the photosensitive drum 103Y charged by the charging device 104Y. As a result, the electrostatic latent image is formed on the photosensitive drum 103Y. Then, the developing device 106Y develops the electrostatic latent image, formed on the photosensitive drum 103Y, with yellow toner. A resultant yellow toner image formed on the photosensitive drum 103Y through development of the electrostatic latent image is transferred onto the intermediary transfer belt 107 by the primary transfer roller 108Y. The toner images of magenta, cyan and black are also transferred onto the intermediary transfer belt 107 by a similar image forming process.

The respective color toner images transferred on the intermediary transfer belt 107 are fed to a secondary transfer portion T2 by the intermediary transfer belt 107. To the secondary transfer roller 109 disposed at the secondary transfer portion T2, a transfer bias for transferring the toner images onto the recording paper P has been applied. The toner images fed to the secondary transfer portion T2 are transferred, onto the recording paper P fed from the paper feeding portion 101, under application of the transfer bias to the secondary transfer roller 109. The recording paper P on which the toner images are transferred is fed to the fixing device 100. The fixing device 100 fixes the toner images on the recording paper P by heat and pressure. The recording paper P subjected to a fixing process by the fixing device 100 is discharged onto a paper discharge portion 111.

(Drum Unit and Developing Unit)

In the image forming apparatus 1 of this embodiment, drum units 518Y, 518M, 518C and 518K (hereinafter, also referred to collectively and simply as a "drum unit 518"), which are examples of exchangeable replacement units, are mounted. The drum unit 518 is a cartridge to be exchanged by an operator such as a user or a maintenance person. The drum unit 518 in this embodiment rotatably supports the photosensitive drum 103. Specifically, the photosensitive drum 103 is rotatably supported by a frame of the drum unit 518. Incidentally, the drum unit 518 may also have a constitution in which the charging unit 104 and a cleaning device are not provided.

Further, in the image forming apparatus 1 of this embodiment, developing units 641Y, 641M, 641C and 641K (hereinafter, also referred to collectively and simply as a "developing unit 641"), which are separate members from the drum unit 518, are mounted. The developing unit 641 is a cartridge prepared by integrally assembling the developing device 106 shown in part (a) of FIG. 1 and a toner accommodating portion into a unit. The developing unit 641 includes a developing sleeve which is a developer carrying member for carrying a developer (toner and a carrier). The developing unit 641 is provided with a plurality of gears for rotating a screw for stirring the toner and the carrier. When these gears are aging, deteriorated or the like, the operator dismounts the developing unit 641 from the apparatus main assembly of the image forming apparatus 1 and exchanges the developing unit 641 with a new one. Incidentally, the forms of the drum unit 518 and the developing unit 641 may also be a process cartridge prepared by integrally assembling the drum unit 518 and the developing unit 641 into a unit.

Figure 2:
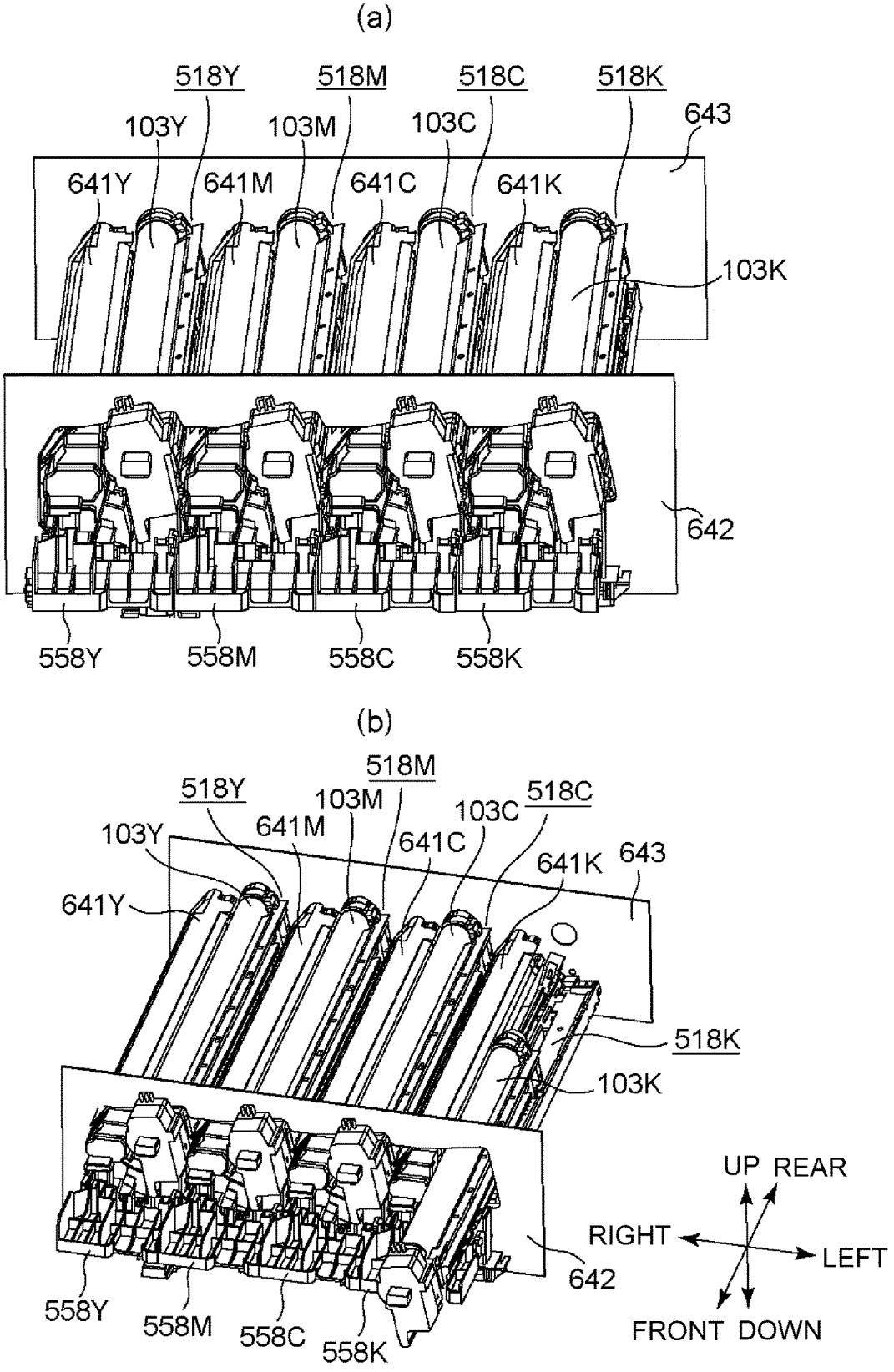

Part (a) of FIG. 2 is a perspective view showing a schematic structure of the drum unit 518, the developing unit 641 and peripheral portions thereof. Part (b) of FIG. 2 is a perspective view showing a state in which the drum unit 518 is being inserted from an outside of the apparatus main assembly into the image forming apparatus 1.

As shown in part (a) of FIG. 2, the image forming apparatus 1 includes a front side plate 642 formed with a metal plate and a rear side plate 643 formed with a metal plate. The front side plate 642 is a side wall provided on a front side of the image forming apparatus 1. The rear side plate 643 is a side wall provided on a rear side of the image forming apparatus 1. As shown in part (a) of FIG. 2, the front side plate 642 and the rear side plate 643 are disposed opposed to each other, and an unshown metal plate as a beam is bridged between these plates. Each of the front side plate 642, the rear side plate 643 and the unshown beam constitutes a part of a frame of the image forming apparatus 1.

The front side plate 642 is provided with an opening through which the drum unit 518 and the developing unit 641 can be inserted from the front side into and extracted from the image forming apparatus 1. The drum unit 518 and the developing unit 641 are mounted at a predetermined position of the main assembly of the image forming apparatus 1 through the opening (mounting position). Further, the image forming apparatus 1 includes covers 558Y, 558M, 558C and 558K (hereinafter, also referred to collectively and simply as a "cover"), each for covering a front side of both of the drum unit 518 and the developing unit 641 which are mounted in the mounting position. The cover is fixed at one end thereof to the main assembly of the image forming apparatus 1 by a hinge, whereby the cover 558 is rotatable relative to the main assembly of the image forming apparatus 1. The operator opens the cover 558 and takes the drum unit 518 or the developing unit 641 out of the image forming apparatus 1, and then inserts a new drum unit 518 or a new developing unit 641 into the image forming apparatus 1 and closes the cover 558, whereby an exchanging operation is completed.

Here, as shown in parts (a) and (b) of FIG. 2, in the following description, relative to the apparatus main assembly, the front side plate 642 side and the rear side plate 643 side are defined as a front side and a rear side, respectively. Further, when a position of the photosensitive drum 103K on which the electrostatic latent image relating to the black toner image is formed is taken as a reference position, a side where the photosensitive drum 103Y on which the electrostatic latent image relating to the yellow toner image is formed is disposed is defined as a right side. Further, when a position of the photosensitive drum 103Y is taken as a reference position, a side where the photosensitive drum 103K is disposed is defined as a left side. Further, with respect to a direction perpendicular to a front-rear direction and a left-right direction, an upward direction in a vertical direction is defined as an up direction and a downward direction in the vertical direction is defined as a down direction. The front direction, the rear direction, the right direction, the left direction, the up direction and the down direction defined above are shown in part (b) of FIG. 2. Further, in the following description, a rotational axis direction of the photosensitive drum 103 substantially coincides with a front-rear direction shown in FIG. 2. Further, this direction also substantially coincides with a longitudinal direction of an optical print head 105.

(Exposure unit)

Next, the exposure unit 500 including an optical print head 105 will be described. Here, as an example of an exposure type employed in an image forming apparatus of an electrophotographic type, there is a laser beam scanning exposure type in which a beam emitted from a semiconductor laser is deflected for scanning by a rotating polygon mirror and the photosensitive drum 103 is exposed to the beam through an f-θ lens or the like. The "optical print head 105" described in this embodiment is used in an LED exposure type in which the photosensitive drum 103 is exposed to light by using light emitting elements such as LEDs or the like arranged along the rotational axis direction of the photosensitive drum 103 and thus is not used in the laser beam scanning exposure type described above.

Figure 3:
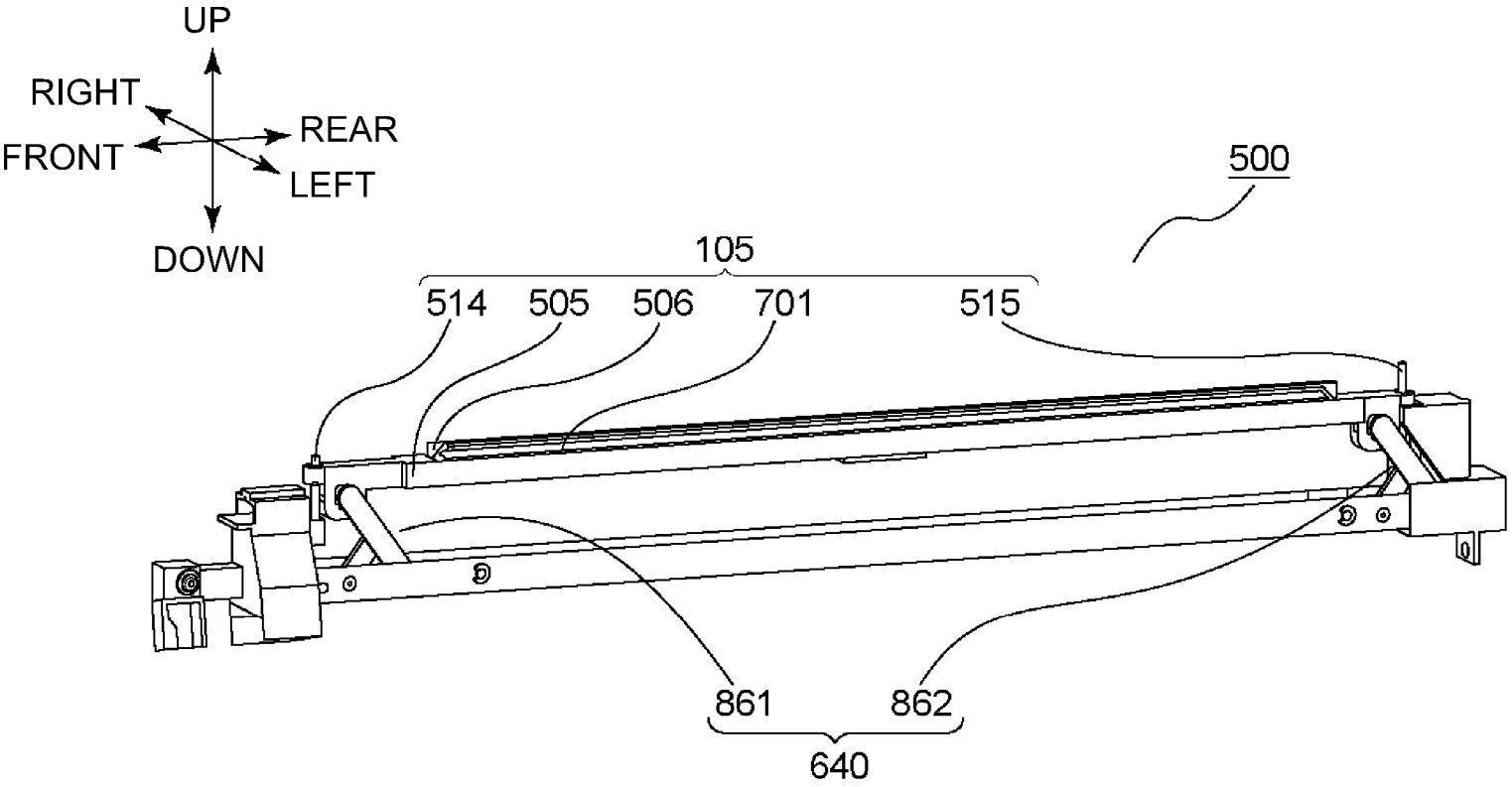
FIG. 3 is a schematic perspective view of an exposure unit.

The exposure unit 500 described in this embodiment is provided on a side below a rotational axis of the photosensitive drum 103 with respect to the vertical direction, and the photosensitive drum 103 is exposed to light from below by LEDs 503 of the optical print head 105. However, a constitution in which the exposure unit 500 is provided on a side above the rotational axis of the photosensitive drum 103 with respect to the vertical direction and in which the photosensitive drum 103 is exposed to light from above by the LEDs 503 of the optical print head 105 may also be employed (part (b) of FIG. 1). FIG. 3 is a schematic perspective view of the exposure unit 500 provided in the image forming apparatus 1 of this embodiment.

Referring to FIG. 3, the exposure unit 500 includes the optical print head 105 and a moving mechanism 640. The optical print head 105 includes a lens array 506 a holding member 505 for holding a supporting portion 705 and a substrate 502 (which are not shown in FIG. 3), a first contact member 514, and a second contact member 515.

The first contact member 514 and the second contact member 515 contact the drum unit 518, so that a gap (interval) is formed between the lens array 506 and the photosensitive drum 103, and thus a position of the optical print head 105 during image formation is determined. The moving mechanism 640 includes a first link mechanism 861 and a second link mechanism 862. In interrelation with an opening and closing operation of the cover, the first link mechanism 861 and the second link mechanism 862 are driven, so that the optical print head 105 is moved upward and downward. Of the frame of the drum unit 518, portions on which the contact members (514, 515) abut, for example, engaging holes in which free end portions of these contact members (514, 515) engage by about 5 mm, are provided. As a result, the optical print head 105 is accurately positioned to the photosensitive drum 3.

For explaining a structure of the optical print head 105, first, the holding member 505 will be described. The holding member 505 is a holder for holding the substrate 502 and the lens array 506 which are described later. Although description will be specifically made later, the lens array 506 is supported by the supporting portion 705, provided as a part of the holding member 505, over the rotational axis direction of the photosensitive drum 103. In this embodiment, from viewpoints of weight reduction and cost reduction of the optical print head 105 itself, as a material of the holding member 505, a resin material is used, but the holding member 505 may also be made of metal.

Next, the substrate 502 held by the holding member 505 will be described.

Part (a) of FIG. 4 is a schematic perspective view of the substrate 502. Part (b1) of FIG. 4 is a schematic view for illustrating a plurality of LED chips 639 mounted on the substrate 502. Part (b2) of FIG. 4 is an enlarged view of part (b1) of FIG. 4 and is a schematic view showing a plurality of LEDs 503 (examples of light emitting elements) provided in the LED chips 639.

As shown in part (a) of FIG. 4, on one surface of the substrate 502, the LED chips 639 are provided, and on the other surface of the substrate 502 (i.e., on the surface opposite from a side where the light emitting elements are arranged) an elongated connector 504 is provided. This connector 504 is mounted on a lower surface of the substrate 502 so that a longitudinal direction thereof extends along a longitudinal direction of the substrate 502. On the substrate 502, electrical wiring for supplying signals to the respective LED chips 639 is provided. To the connector 504, one end of an unshown flexible flat cable (FFC) as an example of a cable is connected. In the image forming apparatus 1 main assembly, a substrate including a controller and a connector is provided. The other end of the FFC is connected to the connector. That is, the FFC electrically connects the controller and the substrate 502. To the substrate 502, a control signal (driving signal) is inputted from the controller of the image forming apparatus 1 main assembly through the FFC and the connector 504.

The LED chips 639 mounted on the substrate 502 will be described further specifically. As shown in parts (b1) and (b2) of FIG. 4, on one surface of the substrate 502, a plurality of LED chips 639-1 to 639-29 (29 LED chips), each having a plurality of LEDs 503, are disposed. On each of the LED chips 639-1 to 639-29, 516 LEDs 503 are arranged in a line along a longitudinal direction of the LED chips 639. With respect to the longitudinal direction of the LED chips 639, a center distance k2 between adjacent LEDs 503 corresponds to resolution of the image forming apparatus 1. The resolution of the image forming apparatus 1 is 1200 dpi, and therefore, in the longitudinal direction of the substrate 502, the LED chips 639-1 to 639-29 are arranged in a line so that the center distance of the LEDs 503 is 21.16 μm. For that reason, an exposure range of the optical print head 105 in this embodiment is about 314 mm. A photosensitive layer on the photosensitive drum 103 is formed with a width of 314 mm or more. A long-side length of A4-size recording paper and a short-side length of A3-size recording paper are 297 mm, and therefore, the optical print head 105 in this embodiment has the exposure range in which the image can be formed on the A4-size recording paper and the A3-size recording paper.

The LED chips 639-1 to 639-29 are alternately disposed in two (parallel) lines along the rotational axis direction. That is, as shown in part (b1) of FIG. 4, odd-numbered LED chips 639-1,

639-3, . . . 639-29 counted from a left side are mounted on the substrate 502 in a line with respect to the longitudinal direction, and even-numbered LED chips 639-2, 639-4, . . . 639-28 counted from the left side are mounted on the substrate 502 in a line with respect to the longitudinal direction. By disposing the LED chips 639 in such a manner, as shown in part (b2) of FIG. 4, with respect to the longitudinal direction of the LED chips 639, a center distance k1 between one end of one (e.g., 639-1) of adjacent (different) LED chips 639 and the other end of the other one (e.g., 639-2) of the adjacent LED chips 639 can be made equal to the center distance k2 between the adjacent LEDs 503 on one (e.g., 639-1) of LED chips 639. Incidentally, in this embodiment, a constitution using the LEDs 503 as an exposure light source is described as an example, but as the exposure light source, an organic EL (electro luminescence) device may also be used.

Next, a lens array 506 will be described. Part (c1) of FIG. 4 is a schematic view of the lens array 506 as seen from the photosensitive drum 103 side. Further, part (c2) of FIG. 4 is a schematic perspective view of the lens array 506. As shown in part (c1) of FIG. 4, a plurality of lenses are arranged in two lines along an arrangement direction of the plurality of LEDs 503. The respective lenses are alternately disposed so that with respect to an arrangement direction of the lenses arranged in one line, one of lenses arranged in the other line contacts both of adjacent two lenses arranged in the arrangement direction of the lenses arranged in the above-described one line. Each of the lenses is a cylindrical rod lens made of glass. Incidentally, a material of the lens is not limited to glass but may also be plastics. Also shapes of the lenses are not limited to the cylindrical shape but may also be a polygonal prism shape such as a hexagonal prism shape.

A broken line Z shown in part (c2) of FIG. 4 represents an optical axis of the lens. The optical print head 105 is movable by the moving mechanism 640 in a direction (up-down direction) roughly along the optical axis of the lens indicated by the broken line Z. The optical axis of the lens referred to herein means a line connecting a center of a light emergent surface of the lens and a focus of the lens. Emitted light emitted from the LED 503 enters the lens of the lens array 506. The lens has a function of focusing the emitted light entering the lens on the surface of the photosensitive drum 103. A mounting position of the lens array 506 relative to the holding member 505 (FIG. 3) is adjusted during assembling of the optical print head 105 so that a distance between a light emergent surface of the LED 503 and a light incident surface of the lens and a distance between a light emergent surface of the lens and the surface of the photosensitive drum are substantially equal to each other, and the lens array 506 is bonded to the holding member 505 with an adhesive.

(Assembling method of optical print head)

Next, with reference to FIGS. 2 to 8, a method of mounting the substrate 502 on the holding member 505 and a method of mounting the lens array 506 on the holding member 505 will be described.

First, the mounting method of the lens array 506 on the holding member 505 will be described. Part (a) of FIG. 5 is a schematic view of a front side of the holding member 505 as seen from a lower side, in which the substrate 502 and the lens array 506 are not shown. As shown in part (a) of FIG. 5, the holding member 505 is provided with a through hole 906 formed so as to extend over a front-rear direction of the holding member 505. Light beams emitted from the plurality of LEDs 503 pass through this through hole 906. In other words, the holding member 505 is provided with the through hole 906 in which the lens array 506 is engageable. Although detailed description will be made later, the lens array 506 is inserted into the through hole 906, and is fixed to the holding member 505 after adjustment of a mounting position of the lens array 506 relative to the holding member 505. For fixing between the lens array 506 and the holding member 505, an adhesive 907 is used. At a boundary portion between the lens array 506 and the holding member 505, the adhesive 907 is applied, so that the lens array 506 is adhesively fixed to the holding member 505.

Part (b1) of FIG. 5 is a schematic perspective view of the holding member 505 (the lens array 506 is not shown in the figure) on the front side. Part (b2) of FIG. 5 is a sectional view of the holding member 505 (the lens array 506 is not shown in the figure) as seen from the front side in a cross-section cut along a plane perpendicular to the rotational axis direction of the photosensitive drum 103. Further, part (c1) of FIG. 5 is a schematic perspective view of the holding member 505, to which the lens array 506 is adhesively bonded, on the front side, and part (c2) of FIG. 5 is a sectional view of the holding member 505, to which the lens array 506 is adhesively bonded, as seen from the front side in a cross-section cut along a plane perpendicular to the rotational axis direction of the photosensitive drum 103. As shown in parts (b1) and (b2) of FIG. 5, on an upper side of the holding member 505, the supporting portion 705, in which the lens array 506 is mounted, is provided. The supporting portion 705 includes a first opposing portion 701 and a second opposing portion 702. The first opposing portion 701 and the second opposing portion 702 are formed along an edge of the through hole 906 so as to extend over the front-rear direction thereof. The first opposing portion 701 and the second opposing portion 702 oppose each other via the through hole 906 with respect to the left-right direction in order to form an interval (spacing) in which the lens array 506 is inserted. The first opposing portion 701 has a first opposing surface 507 opposing a right-side wall surface of the lens array 506 inserted through the through hole 906, and the second opposing portion 702 has a second opposing surface 508 opposing a left-side wall surface of the lens array 506 inserted through the through hole 906. In a state in which the lens array 506 is not inserted into the through hole 906, the first opposing surface 507 and the second opposing surface 508 oppose each other with respect to the left-right direction thereof. Here, the right-side wall surface of the lens array 506 means a side wall surface on one side of the lens array 506 with respect to a direction perpendicular to both the rotational axis direction of the photosensitive drum 103 and the optical axis direction of the lenses, and the left-side wall surface of the lens array 506 means a side wall surface on the other side of the lens array 506 with respect to the direction perpendicular to both the rotational axis direction of the photosensitive drum 103 and the optical axis direction of the lenses.

The lens array 506 inserted through the through hole 906 is adhesively fixed to the supporting portion 705 in a state in which a part thereof is projected upwardly from the supporting portion 705. On an upper side of the first opposing surface 507, a first inserted surface 703 inserted rightwardly and upwardly with an ascending level is provided. Further, on an upper side of the second opposing surface 508, a second inserted surface 704 inserted leftwardly and upwardly with an ascending level is provided. Adhesive bonding between the lens array 506 and the supporting portion 705 of the holding member 505 is carried out by applying the adhesive 907 onto the first inserted surface 703 and the second inserted surface 704 in a state in which the lens array 506 is inserted in the through hole 906. Thus, the surfaces on which the adhesive 907 is applied are inserted so as to approach the both side wall surfaces (the right-side wall surface and the left-surface wall surface) of the lens array 506 with a descending level, whereby the applied adhesive 907 flows toward a lower portion of the lens array 507 along the first inserted surface 703 and the second inserted surface 704 by a self-weight thereof. Therefore, the lens array 506 and the supporting portion 705 are easily bonded together.

Part (d) of FIG. 5 is a schematic view for illustrating a structure in which a first bottom portion 715 is provided between the first inserted surface 703 and the first opposing surface 507 and a second bottom portion 716 is provided between the second inserted surface 704 and the second opposing surface 508. The first bottom portion 715 is a surface which is substantially perpendicular to the optical axis direction of the lenses and which is continuous to both the first opposing surface 507 and the first inserted surface 703. Further, the second bottom portion 716 is also a surface which is substantially perpendicular to the optical axis direction and which is continuous to both the second opposing surface 508 and the second inserted surface 704. In the state in which the lens array 506 is inserted through the through hole 906, the adhesive 907 is applied onto the first bottom portion 715 and the second bottom portion 716, so that the lens array 506 and the supporting portion 705 are adhesively fixed to each other. Thus, by providing the first bottom portion 715 and the second bottom portion 716, compared with the case where these portions are not provided, a space into which the adhesive 907 can flow increases, so that the adhesive 907 can be easily caused to flow into the space.

Next, the mounting method of the substrate 502 on the holding member 505 will be described using parts (a) and (b2) of FIG. 5. On a lower side of the holding member 505, an opening 908 for permitting insertion of the substrate 502 therethrough is formed. The holding member 505 includes a first portion-to-be-contacted 911A and a second portion-to-be-contacted 911B which are contactable to a part of the substrate 502 when the substrate 502 is inserted into the holding member 505 from a lower side of the holding member 505 through the opening 908. The first portion-to-be-contacted 911A is formed immediately on a first opposing surface 901 formed at the first opposing portion 701, and the second portion-to-be-contacted 911B is formed immediately on a second opposing surface 902 formed at the second opposing portion 702. When the substrate 502 is inserted from the lower side of the holding member 505 through the opening 908, an upper surface of the substrate 502 on the right side contacts the first portion-to-be-contacted 911A and the upper surface of the substrate 502 on the left side contacts the second portion-to-be-contacted 911B. As a result, a mounting position of the substrate 502 relative to the holding member 505 is determined.

The substrate 502 of which mounting position relative to the holding member 505 is determined is adhesively fixed to the holding member 505 by applying the adhesive 907 onto a boundary surface between the substrate 502 and the first opposing surface 901 and a boundary surface between the substrate 502 and the second opposing surface 902 in a state in which the substrate 502 contacts both the first portion-to-be-contacted 911A and the second portion-to-be-contacted 911B.

Next, using parts (a) to (c) of FIG. 6, a method of adjusting the mounting position of the lens array 506 relative to the holding member 505 when the lens array 506 is mounted on the holding member 505 will be described. Parts (a) to (c) of FIG. 6 are schematic views of the holding member 505 as seen from the left side in a state in which the lens array 506 is inserted through the through hole 906.

Part (a) of FIG. 6 is a schematic view of the holding member 505 in this embodiment. From part (a) of FIG. 6, a distance from a front side end portion to a rear side end portion of the supporting portion 705 is shorter than a distance from a front side end portion to a rear side end portion of the lens array 506. As a result, the lens array 506 inserted through the through hole 906 of the holding member 505 is exposed from the supporting portion 705 on the front side and the rear side (exposed portions 912).

When a distance from a light emergent point of the LED 503 provided on the substrate 502 to an incident surface of the lens array 506 on which the light of the LED 503 emitted from the light emergent point is incident is k, a value of a focal length of the lens array 506 corresponding to the distance k is determined at the time of completion of manufacturing the lenses. It cannot be said that the value is the same value for all the lenses when a manufacturing error or the like is taken into consideration. Accordingly, during assembling of the optical print head 105, there is a need to adjust the mounting position of the lens array 506 so that the distance from the light emergent point of the LED 503 to the light incident surface of the lens array 506 is a proper distance. Therefore, the mounting position is adjusted in a state in which the exposed portions 912 of the lens array 506 are gripped by the gripping movement such as an assembling device, for example, and are inserted through the through hole 906. In this embodiment, a projection length (x (mm) in part (a) of FIG. 6) of the lens array 506 from an upper end of the supporting portion 705 is about 2 mm. On the other hand, a projection length (y (mm) in part 8*a*) of FIG. 6) of the exposed portions 912 from an upper end of the holding member 505 is 4.3 mm. By the presence of the exposed portions 912, a region in which the lens array 506 can be gripped increases, and therefore, the lens array 506 can be gripped with reliability.

Based on the above description, the assembling method of the optical print head 105 will be summarized. First, the exposed portions 912 of the lens array 506 are sandwiched from the left-right direction by the gripping mechanism such as the assembling device (gripping step). The lens array 506 sandwiched by the gripping mechanism is inserted into the holding member 505 through the through hole 906 (disposing step). At this time, the exposed portions 912 are exposed from both front and rear ends of the supporting portion 705, and therefore, the gripping mechanism and the holding member 505 are prevented from contacting each other. Then, in a state in which the lens array 506 is inserted through the through hole 906, the substrate 502 is contacted to the portions-to-be-contacted 911A and 911B, and the LED 503 emits light. The light passing through the lens array 506 is received by a light receiving device or the like (light receiving step), and on the basis of a light receiving result, a positional relationship between the lens array 506 and the holding member 505 is adjusted while moving the lens array 506 in an up-down direction (adjusting step). After the adjustment, the lens array 506 and the holding member 505 are adhesively fixed by the adhesive 907. Incidentally, the step of causing the substrate 502 to contact the portions-to-be-contacted 911A and 911B may also be performed before the disposing step.

The exposed portions 912 are not limited to portions shown by broken line circles in part (a) of FIG. 6, but may also be portions shown by broken line circles in part (b) of FIG. 6. In part (b) of FIG. 6, both front and rear ends of the supporting portion 705 have stepped portions where an upper surface of the supporting portion 705 is more spaced from the photosensitive drum 103 at a position closer to the associated end. By employing such a constitution, a part of the lens array 506 is exposed on each of the both front and rear end sides of the supporting portion 705 (exposed portions 922). The exposed portions 922 are gripped from the left-right direction by the gripping mechanism such as the assembling device, and the mounting position of the lens array 506 on the holding member 505 is finely adjusted, and after the adjustment, the lens array 506 and the holding member 505 are adhesively fixed with the adhesive 907.

Further, part (c) of FIG. 6 shows a constitution in which recessed portions are formed on the upper surface of the supporting portion 705 on left and right sides of the supporting portion 705. By employing such a constitution, as shown in part (c) of FIG. 6, side wall surfaces of the lens array 506 on both the left and right sides of the lens array 506 are exposed from the recessed portions (exposed portions 932). The exposed portions 932 are gripped from the left-right direction by the gripping mechanism such as the assembling device, and the mounting position of the lens array 506 on the holding member 505 is finely adjusted, and after the adjustment, the lens array 506 and the holding member 505 are adhesively fixed with the adhesive 907.

(Cleaning Mechanism)

In the image forming apparatus 1, for example, the exposure means such as the optical print head 105 is provided between the charging device 104 and the developing device 106. For that reason, in some instances, the light emergent surface of the lens array 506 is contaminated with toner falling from the photosensitive drum 103 or the developing device 106. There is a liability that the light emitted from the light emitting element is partly blocked by a contaminant on the lens array 506, so that the contaminant can constitute a cause of an occurrence of a lowering in image quality of an output image. Therefore, the light emergent surface of the optical print head 105 may desirably be cleaned periodically.

Part (a) of FIG. 7 is a schematic perspective view of a bar like cleaning member 572 used for cleaning the light emergent surface of the lens array 506. Here, as shown in part (a) of FIG. 7, a longitudinal direction, a widthwise direction, a front side and a rear side of the cleaning member 572 are defined. The cleaning member 572 includes a gripping portion 575 on a rear end side thereof. On a lower front end side of the cleaning member 572, a sliding portion 574 (not shown in the figure) is provided as described later. Further, the cleaning member 572 is provided with a stopper 582 on a rear end side thereof so as to be positioned closer to the front end side than the gripping portion 575 is. The stopper 582 is a projection projecting from the cleaning member 572 and is provided on a side opposite from the side where the sliding portion 574 (not shown in the figure) is provided.

Part (b) of FIG. 7 shows a state in which the cleaning member 572 is inserted through a receiving portion 700 provided on a front side of the holding member 505. In a state in which the cleaning member 572 is inserted through the receiving portion 700, the longitudinal direction of the cleaning member 572 and the rotational axis direction of the photosensitive drum 103 are substantially the same direction. The operator grips the gripping portion 575 and cleans the light emergent surface of the lens array 506 by operating the cleaning member 572 (i.e., inserting and extracting the cleaning member 572 through the receiving portion 700). Incidentally, when the operator inserts the cleaning member 572 through the receiving portion 700 from an outside of the main assembly of the image forming apparatus 1 and moves the cleaning member 572 in a direction from the front side toward the rear side of the apparatus main assembly (i.e., a direction from the receiving portion 700 toward a portion-to-be-engaged 579 described later), the stopper 582 abuts against a portion-to-be-contacted 777 provided as a part of the receiving portion 700, so that movement of the cleaning member 572 is limited. Incidentally, in this embodiment, the receiving portion 700 is provided on the front side of the holding member 505, but is not limited to being provided on the holding member 505, and may only be required to be fixed on a front side (one side) of the main assembly of the image forming apparatus 1 relative to the lens array with respect to the rotational axis direction of the photosensitive drum 103, for example, to be fixed at a front side end portion of the drum unit 518. Further, in this embodiment, the receiving portion 700 includes an opening extending in the front-rear direction, but for example, the receiving portion 700 may also include a cut-away portion at an upper portion thereof, and is not necessarily required to be a hole as shown in part (b) of FIG. 7.

An opening of the receiving portion 700 is larger than a cross-section of the cleaning member 572 cut along a direction perpendicular to the longitudinal direction of the cleaning member 572. The cleaning member 572 is slidable in the direction perpendicular to the longitudinal direction thereof by about 0.5-1 mm relative to the receiving portion 700 in a state in which the cleaning member 572 is inserted through the receiving portion 700. Thus, the cleaning member 572 inserted through the receiving portion 700 has some play relative to the receiving portion 700. By this play, a frictional force due to contact between the receiving portion 700 and the cleaning member 572 inserted through the receiving portion 700 and operated by the operator is suppressed.

Part (a) of FIG. 8 is a perspective view of the cleaning member 572 on the front side as seen from a lower side thereof. Part (b) of FIG. 8 is a sectional view of the cleaning member 572 cut along a plane perpendicular to a rotational axis direction of the photosensitive drum 103.

As shown in parts (a) and (b) of FIG. 8, the cleaning member 572 includes the sliding portion 574, engaging portions 576, lower projected portions 577 and an upper projected portion 578.

The sliding portion 574 is provided on the front lower side of the cleaning member 572. The sliding portion 574 is a nonwoven fabric constituted by fibers of cotton, nylon, polyester or the like, and cleans the light emergent surface of the lens array 506 by wiping off the toner or the like falling on the light emergent surface. Incidentally, the sliding portion 574 is not limited to the nonwoven fabric but may also be an elastically deformable blade made of a rubber such as sponge or elastomer, so that the light emergent surface may also be cleaned by scraping off the contaminant such as the toner falling on the light emergent surface of the lens array 506.

The engaging portions 576 have a function of engaging the cleaning member 572 with the holding member 505 so that the sliding portion 574 contacts the light emergent surface of the lens array 506. The engaging portions 576 are projections projecting from left and right sides, respectively, of the cleaning member 572 downwardly on the front side of the cleaning member 572. Each of free ends of the projections has a shape such that the free end is bent inwardly. Here, of the engaging portions 576, which are the projections projecting from the right side and the left side, respectively, of the cleaning member 572, the projection projecting toward the left side is referred to as a first projected portion and the projection projecting toward the right side is referred to as a second projected portion. The first projected portion engages with a first rail described later, and the second projected portion engages with a second rail described later. The projection projecting toward the right side may also be referred to as the first projected portion, and the projection projecting toward the left side may also be referred to as the second projected portion. When the operator inserts the cleaning member 572 through the receiving portion 700, the engaging portions 576 engage with intervals (gaps) 579 (examples of portions-to-be-engaged). The engaging portions 576 are movable together with the cleaning member 572 along the longitudinal direction of the portions-to-be-engaged 579 in a state in which the engaging portions 576 engage with the portions-to-be-engaged 579. Incidentally, of the intervals 579 formed on both the right side and the left side of the holding member 505, the right side interval 579 is referred to as the first rail, and the left side interval 579 is referred to as the second rail. The left side interval 579 may also be referred to as the first rail, and the right side interval 579 may also be referred to as the second rail.

The lower side projected portions 577 are provided on a lower side of the cleaning member 572 along the longitudinal direction of the cleaning member 572 so as to oppose an upper side of the holding member 505 when the cleaning member 572 is inserted through the receiving portion 700. The lower side projected portions 577 contact the upper side of the projected portion 580 of the holding member 505, so that intervals (gaps) are formed between the cleaning member 572 and the light emergent surfaces of the lens array 506. As a result, on the lower side of the cleaning member 572, portions other than the sliding portion 574 do not contact the lens array 506. For that reason, the light emergent surfaces of the lens array 506 can be prevented from being damaged by the operation of the cleaning member 572 by the operator.

Part (a) of FIG. 9 is an enlarged perspective view of a guiding portion 918 formed on the holding member 505. Parts (b) and (c) of FIG. 9 are perspective views for illustrating a function of the guiding portion 918. The guiding portion 918 is formed on the upper side and the front side of the holding member 505 so as to be positioned at a level higher than the supporting portion 705. The guiding portion 918 is provided on the front side of the holding member 505 with an interval from the front side of the supporting portion 705 with respect to the front-rear direction (the rotational axis direction of the photosensitive drum 103). For that reason, the gripping mechanism gripping the exposed portions 912 during the adjustment of the mounting position of the lens array 506 relative to the holding member 505 does not interfere with the guiding portion 918.

The guiding portion 918 includes, for example, as shown in part (a) of FIG. 9, projected portions 919 projecting from both the left and right sides thereof. As a result, intervals (gaps) 920 (as an example of grooves) are formed between the upper surface of the holding member 505 and the projected portions 919. Incidentally, the interval 920 formed between the holding member 505 and the projected portion 919 projecting from the right side of the guiding portion 918 is referred to as a third rail, and the interval 920 formed between the holding member 505 and the projected portion 919 projecting from the left side of the guiding portion 918 is referred to as a guiding rail. A positional relationship between the third rail and the fourth rail may also be reversed. The first projected portion of the cleaning member 572 inserted through the receiving portion 700 engages with the third rail, and the second projected portion of the cleaning member 572 inserted through the receiving portion 700 engages with the fourth rail. When the cleaning member 572 is inserted through the receiving portion 700 by the operator, the engaging portions 576 move toward the intervals 920 of the guiding portion 918. The receiving portion 700 in this embodiment has a full length of about 40 mm with respect to the front-rear direction of the opening thereof. A distance from a rear end of the receiving portion 700 to a front end of the projected portions 919 formed as parts of the guiding portion 918 is about 36 mm. The full length of the receiving portion 700 with respect to the front-rear direction of the opening thereof is about 40 mm, and therefore, movement of the cleaning member 572 inserted through the receiving portion 700 in the direction perpendicular to the rotational axis direction of the photosensitive drum 103 is limited to some extent. Incidentally, the "direction perpendicular to the rotational axis direction of the photosensitive drum 103" mentioned herein is a direction which is substantially the same as the direction in which the cleaning member 572 is inserted and moved through the receiving portion 700 by the operator.

The operator is capable of easily engaging the engaging portions 576, formed as parts of the cleaning member 572, with the intervals 920 of the guiding portion 918. The engaging portions 576 and the projected portions 919 engage with each other with respect to the up-down direction, so that the engaging portions 576 and the intervals 920 of the guiding portion 918 are in an engaging state. The projected portions 919 are extended and formed along the front-rear direction of the intervals 920 of the guiding portion 918, and therefore, also the intervals 920 formed between the holding member 505 and the projected portions 919 are extended and formed along the front-rear direction (the rotational axis direction of the photosensitive drum 103). A full length of the intervals 920 of the guiding portion 918 with respect to the front-rear direction is about 8.7 mm. The engaging portions 576 and the intervals 920 of the guiding portion 918 are in the engaging state, so that a movement direction of the cleaning member 572 moved by the operator is regulated by the intervals 920 of the guiding portion 918 so as to be the same as the rotational axis direction of the photosensitive drum 103.

Here, the case where the intervals 920 of the guiding portion 918 do not exist, i.e., the case where the image forming apparatus 1 has a constitution in which the guiding portion 918 is not provided, will be considered. As described above, between the receiving portion 700 and the cleaning member 572 inserted through the receiving portion 700, some play (about 0.5-1 mm) exists. For that reason, the cleaning member 572 is swingable in the direction perpendicular to the longitudinal direction of the cleaning member 572 even in a state in which the cleaning member 572 is inserted through the receiving portion 700. When the operation of the cleaning member 572 through a manual operation by the operator is taken into consideration, the play exists between the receiving portion 700 and the cleaning member 572 inserted through the receiving portion 700, and therefore, there is a possibility that the cleaning member 572 is movable along various moving paths (courses). That is, it is hard for the operator to engage the cleaning member 572 with the portions-to-be-engaged 579 with an increasing distance between the receiving portion 700 and the portions-to-be-engaged 579.

On extension lines of the intervals 920 of the guiding portion 918 with respect to the longitudinal direction, the portions-to-be-engaged 579 formed between the projected portions 580 provided on the supporting portion 705 and the upper surface of the holding member 505 are positioned. That is, the portions-to-be-engaged 579 and the intervals 920 of the guiding portion 918 exist on the same rectilinear line. A distance from the rear end of the projected portions 919 to the front end of the projected portions 580 is about 6.5 mm. The portions-to-be-engaged 579 are provided on the supporting portion 705 with a spacing from the intervals 920 of the guiding portion 918 with respect to the front-rear direction. When the cleaning member 572 is further moved toward a rear side of the main assembly of the image forming apparatus 1 (in a direction from the receiving portion 700 toward the portions-to-be-engaged 579) in a state in which the engaging portions 576 engage with the intervals 920 of the guiding portion 918, the engaging portions 576 pass through the guiding portion 918 and then engage with the portions-to-be-engaged 579 formed between the projected portions 580 and the upper surface of the holding member 505. Then, the engaging portions 576 engage with the projected portions 580 with respect to the up-down direction, so that the engaging portions 576 and the portions-to-be-engaged 579 are in an engaging state. That is, by the guiding portion 918 provided between the receiving portion 700 and the portions-to-be-engaged 579, movement of the cleaning member 572 inserted through the receiving portion 700 is guided, so that the cleaning member 572 engages with the portions-to-be-engaged 579. When the engaging portions 576 and the portions-to-be-engaged 579 are in the engaging state and the sliding portion 574 is positioned on the lens array 506, the sliding portion 574 contacts the light emergent surfaces of the lens array 506. Further, the portions-to-be-engaged 579 are formed from the other end side to the one end side of the holding member 505 (the supporting portion 705) with respect to the longitudinal direction of the photosensitive drum 103. For that reason, in the case where the engaging portions 576 and the portions-to-be-engaged 579 are in the engaging state, when the cleaning member 572 is operated by the operator, the light emergent surfaces of the lens array 506 are cleaned by the sliding portion 574 with reliability. Incidentally, in a process until the cleaning member 572 is inserted through the receiving portion 700 by the operator and the engaging portions 576 engage with the portions-to-be-engaged 579, the engaging portion 576 may engage with the portions-to-be-engaged 579 after engagement thereof with the intervals 920 of the guiding portion 918 is completely released or may also engage with the portions-to-be-engaged 579 in the state in which the engaging portion 576 engages with the intervals 920 of the guiding portion 918.

Further, at front side end portions of the projected portions 919 of the guiding portion 918, inclined portions 926 inclined upwardly toward the front side are formed. The inclined portions 926 are inclined so that a width of the portions-to-be-engaged 579 increases with a decreasing distance of the portions-to-be-engaged 579 from the receiving portion 700. As a result, the cleaning member 572 inserted through the receiving portion 700 by the operator is induced at its front end by the inclined portions 926 so that the engaging portions 576 move into the intervals 920 of the guiding portion 918. Therefore, the operator is capable of more easily engaging the engaging portions 576 of the cleaning member 572 with the intervals 920 of the guiding portion 918.

FIG. 10 is a schematic perspective view of the optical print head 105 on the front side, in which the guiding portion 918 is omitted from illustration. As shown in FIG. 10, on the upper side of the holding member 505, the projected portions 580, which extend in the rotational axis direction of the photosensitive drum 103 and which project rightwardly and leftwardly (in a direction perpendicular to both the rotational axis direction of the photosensitive drum 103 and the optical axis direction of the lenses), are provided, and form the portions-to-be-engaged 579 between themselves and the upper surface of the holding member 505.

At front side end portions of the projected portions 580, inclined portions 581 indicated as grayed portions in FIG. 10 are formed. The inclined portions 581 are inclined so that a width of the portions-to-be-engaged 579 increases with a decreasing distance of the portions-to-be-engaged 579 from the intervals 920 of the guiding portion 918. As a result, the cleaning member 572 moved from the engaging state with the guiding portion 918 toward the portions-to-be-engaged 579 by the operator is induced at its front end by the inclined portions 581 so that the engaging portions 576 move into the portions-to-be-engaged 579. Therefore, the operator is capable of more easily engaging the engaging portions 576 of the cleaning member 572 with the portions-to-be-engaged 579.

Further, a width of guiding portions of the intervals 920 of the guiding portion 918 is broader than a width of grooves of the portions-to-be-engaged 579. That is, the cleaning member 572 inserted through the receiving portion 700 and moved from the receiving portion 700 toward the portions-to-be-engaged 579 engages with the portions-to-be-engaged 579 in a state in which the cleaning member 572 loosely engages with the intervals 920 of the guiding portion 918.

(Comparison Example)

FIG. 11 shows a constitution of a comparison example to be compared with the present invention, in which the front side end portion of the lens array 506 is not exposed from the front side end portion of the supporting portion 705 (for example, a constitution shown in part (c) of FIG. 6). In the case of such a constitution, intervals (gaps) 953 corresponding to the portions-to-be-engaged 579 of the above-described embodiment can be provided close to a front side end of a holding member 958 to the extent possible.

An optical print head 963 shown in part (a) of FIG. 11 includes the holding member 958, a lens array 952 and a supporting portion 955. The supporting portion 955 is formed over the longitudinal direction of the holding member 958 and supports the lens array 952 from left and right sides. Further, the supporting portion 955 is provided with the intervals 953 over the longitudinal direction thereof In the intervals 953, engaging portions 973 of a cleaning member 971 inserted through a receiving portion 960 are engaged. As a result, a sliding portion 972 can be contacted to light emergent surfaces of the lens array 952 with reliability. The supporting portion 955 is provided so as to extend to the front side end portion of the holding member 958, whereby a distance between the receiving portion 960 and the intervals 953 formed in the supporting portion 955 can be shortened. For that reason, the operator can easily engage the engaging portions 973 in the intervals 953 after the operator inserts the cleaning member 971 through the receiving portion 960.

Incidentally, the front side end portion of the lens array 952 is sufficient when the front side end portion is in front of a front side end portion of an image forming region 957 which is a region used for image formation. In the case of the optical print head 963 shown in part (a) of FIG. 11, a region A indicated by a broken line circle is a region formed for the purpose of providing the intervals 953 so as to be close to the front end of the holding member 958 to the extent possible, and does not contribute to support of the lens array 952. That is, as shown in part (b) of FIG. 11, even when the front side end portion of the lens array 952 is not exposed from the front side end portion of a supporting portion 956, by providing the guiding portion 918 as in the above-described embodiment, there is no need to provide the region A indicated by the broken line circle in part (a) of FIG. 11. As a result, it is possible to suppress a material cost necessary to mold the supporting portion 955.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-235475 filed on Dec. 7, 2017, which is hereby incorporated by reference herein in its entirety.

What is claimed is:

1. An image forming apparatus usable with a cleaning member including a sliding portion and an engaging portion, said image forming apparatus comprising:

a main assembly;

a photosensitive drum rotatable relative to said main assembly;

an optical print head having a light emergent surface from which light with which said photosensitive drum is exposed is emitted;

a receiving portion which is provided on a front side of said main assembly in front of the light emergent surface and through which the sliding portion of the cleaning member configured to slide on and clean the light emergent surface is received from an outside of said main assembly in a longitudinal direction of said optical print head;

a portion-to-be-engaged provided on said optical print head and configured to guide movement of the cleaning member in the longitudinal direction in engagement with the engaging portion such that the sliding portion slides on the light emergent surface; and a guiding portion provided between said portion-to-be-engaged and said receiving portion with an interval from both said portion-to-be-engaged and said receiving portion and configured to guide movement of said cleaning member in a direction from said receiving portion toward said portion-to-be-engaged while limiting movement of said cleaning member in a direction different from the longitudinal direction of the cleaning member to engage the engaging portion with said portion-to-be-engaged.

2. An image forming apparatus according to claim 1, wherein said guiding portion is provided on said optical print head.

3. An image forming apparatus according to claim 1, wherein said optical print head includes a plurality of lenses each having the light emergent surface, wherein said portion-to-be-engaged includes a first rail formed along the longitudinal direction on one side of said optical print head with respect to a perpendicular direction perpendicular to both the longitudinal direction and an optical axis direction of said lenses and a second rail formed along the longitudinal direction on the other side of said optical print head with respect to the perpendicular direction, and wherein the engaging portion includes:

a first projected portion configured to engage with said first rail from the front side toward a rear side of said apparatus main assembly and configured to limit movement of said optical print head in a spacing direction from the light emergent surface by contacting said first rail from a side opposite with respect to said first rail from a side where said photosensitive drum is provided, and a second projected portion configured to engage with said second rail from the front side toward the rear side of said apparatus main assembly and configured to limit movement of said optical print head in a spacing direction from the light emergent surface by contacting said first rail from a side opposite with respect to said second rail from the side where said photosensitive drum is provided.

4. An image forming apparatus according to claim 3, wherein said optical print head includes a lens array including a plurality of said lenses which are arranged in the longitudinal direction and which are integrally provided, and wherein a length of said first rail with respect to the longitudinal direction and a length of said second rail with respect to the longitudinal direction are shorter than a length of said lens array with respect to the longitudinal direction.

5. An image forming apparatus according to claim 3, wherein said guiding portion engages with both said first projected portion and said second projected portion so that said first projected portion engages with said first rail and said second projected portion engages with said second rail, and guides the movement of the cleaning member in the direction from said receiving portion toward said portion-to-be-engaged.

6. An image forming apparatus according to claim 5, wherein said guiding portion includes a third rail formed along the longitudinal direction on one side of said optical print head with respect to the perpendicular direction and a fourth rail formed along the longitudinal direction on the other side of said optical print head with respect to the perpendicular direction, wherein movement of said first projected portion in a direction different from the longitudinal direction by contact of said first projected portion with said third rail from a side opposite, with respect to said third rail, from the side where said photosensitive drum is provided, and wherein movement of said second projected portion in a direction different from the longitudinal direction by contact of said second projected portion with said fourth rail from a side opposite, with respect to said fourth rail, from the side where said photosensitive drum is provided.

7. An image forming apparatus according to claim 1, wherein movement of the engaging portion in a direction different from the longitudinal direction is limited by engagement of the engaging portion with said guiding portion.

8. An image forming apparatus according to claim 7, wherein said receiving portion is an opening through which the cleaning member is inserted, wherein the cleaning member inserted through said receiving portion is moved from said receiving portion toward said portion-to-be-engaged in a state in which movement thereof is in a direction different from the longitudinal direction thereby to engage said engaging portion with said guiding portion.

9. An image forming apparatus according to claim 7, wherein in the cleaning member moved from the receiving portion toward said portion-to-be-engaged, the engaging portion engages with said portion-to-be-engaged in a state in which the engaging portion engages with said guiding portion.

10. An image forming apparatus according to claim 7, wherein said portion-to-be-engaged and said guiding portion are grooves engageable with the engaging portion, and said portion-to-be-engaged and said guiding portion are positioned on the same rectilinear line with respect to the longitudinal direction.

11. An image forming apparatus according to claim 10, wherein on one side of said portion-to-be-engaged with respect to the longitudinal direction, said portion-to-be-engaged is inserted so that a width of the groove increases at a position closer to said guiding portion.

12. An image forming apparatus according to claim 10, wherein on one side of said guiding portion with respect to the longitudinal direction, said guiding portion is inserted so that a width of the groove increases at a position closer to said receiving portion.

13. An image forming apparatus according to claim 1, wherein said receiving portion is fixed to said main assembly.

14. An image forming apparatus according to claim 1, wherein said optical print head includes:

a plurality of light emitting elements configured to emit light with which said photosensitive drum is exposed, a lens array including a plurality of said lenses for focusing the light emitted from said light emitting elements on said photosensitive drum, and a holding member configured to hold said lens array on a side closer to said photosensitive drum than said light emitting elements, wherein the light emergent surface is a surface of said lens array on a side where said photosensitive drum is provided.

15. An image forming apparatus according to claim 14, wherein said portion-to-be-engaged is provided over said holding member from one end side toward the other end side with respect to the longitudinal direction.

16. An image forming apparatus according to claim 14, wherein an end portion of said lens array on one end side with respect to the longitudinal direction is positioned between said portion-to-be-engaged and said guiding portion with respect to the longitudinal direction.

17. An image forming apparatus according to claim 14, wherein said holding member includes a first opposing portion having a first opposing surface opposing a side wall surface of said lens array on one side with respect to a perpendicular direction perpendicular to both the longitudinal direction and an optical axis direction of the lenses of said lens array and a second opposing portion having a second opposing surface opposing a side wall surface of said lens array on the other side with respect to the perpendicular direction, and wherein said lens array is inserted between said first opposing portion and said second opposing portion in a state in which said lens array is gripped by a gripping mechanism for gripping said lens array, both the side wall surfaces on one end side of said lens array and both the side wall surfaces on the other end side of said lens array with respect to the longitudinal direction are exposed from end portions of both said first opposing portion and said second opposing portion with respect to the longitudinal direction so that a position of said lens array, to be fixed to said holding member, relative to said holding member is adjusted.

18. An image forming apparatus according to claim 17, wherein said portion-to-be-engaged is formed at each of said first opposing portion and said second opposing portion.

* * * * *